US011130103B2

(12) United States Patent
Chen

(10) Patent No.: US 11,130,103 B2
(45) Date of Patent: Sep. 28, 2021

(54) ELECTRICALLY CONTROLLED MIXING AND BLENDING APPARATUS FOR CHEMICAL LIQUID RAW MATERIALS

(71) Applicant: Dongguan University Of Technology, Dongguan (CN)

(72) Inventor: Haibin Chen, Dongguan (CN)

(73) Assignee: DONGGUAN UNIVERSITY OF TECHNOLOGY, Dongguan (CN)

( * ) Notice: Subject to any disclaimer, the term of this patent is extended or adjusted under 35 U.S.C. 154(b) by 365 days.

(21) Appl. No.: 16/311,134

(22) PCT Filed: Apr. 18, 2018

(86) PCT No.: PCT/CN2018/083494
§ 371 (c)(1),
(2) Date: Dec. 18, 2018

(87) PCT Pub. No.: WO2019/119688
PCT Pub. Date: Jun. 27, 2019

(65) Prior Publication Data

US 2019/0366282 A1 Dec. 5, 2019

(30) Foreign Application Priority Data

Dec. 20, 2017 (CN) ..... 201711379323.6

(51) Int. Cl.
*B22C 5/00* (2006.01)
*B01F 11/00* (2006.01)
(Continued)

(52) U.S. Cl.
CPC ..... *B01F 11/0054* (2013.01); *B01F 7/1605* (2013.01); *B01F 3/0853* (2013.01);
(Continued)

(58) Field of Classification Search
None
See application file for complete search history.

(56) References Cited

U.S. PATENT DOCUMENTS 4,836,686 A * 6/1989 Sukup ..... B01F 7/1655 366/261
4,854,719 A * 8/1989 Sukup ..... B01F 7/1655 366/261
2010/0097882 A1* 4/2010 Uhlenkamp ..... B01F 11/0085 366/243

FOREIGN PATENT DOCUMENTS

CN 101497008 A 8/2009
CN 205794069 U * 12/2016
(Continued)

OTHER PUBLICATIONS

CN205794069U google machine translation, Xie Deyao, "Liquid fertilizer flusher is used in a kind of Poria plantation", Dec. 2016 (Year: 2016).*

*Primary Examiner* — Anshu Bhatia
*Assistant Examiner* — Greg Huan
(74) *Attorney, Agent, or Firm* — Sinorica, LLC

(57) ABSTRACT

An electrically controlled mixing and blending apparatus featuring high corrosion resistance and mixing efficiency includes a housing, a first bearing engaged to both sides of the housing, and the interior of both first bearings being coupled to a first rotating shaft, a second bearing engaged to a surface at the middle of the first rotating shaft and the interior of the second bearing being engaged to a surface of an output shaft of a first motor output shaft. Both sides of the first motor are fixedly coupled to a surface of the first rotating shaft through a first fixed rod. A gear drives the first motor, a blending rod and a stirring rack to swing in the front-rear direction through the first rotating shaft to increase the turbulence of the liquid raw materials, reduce the time
(Continued)

required for mixing raw materials, and improve the production efficiency.

7 Claims, 4 Drawing Sheets

(51) Int. Cl.

| | |
|---|---|
| ***B01F 7/16*** | (2006.01) |
| *B01F 3/08* | (2006.01) |
| *B01F 7/18* | (2006.01) |
| *B01F 15/00* | (2006.01) |

(52) U.S. Cl.
CPC ..... *B01F 7/18* (2013.01); *B01F 11/0088* (2013.01); *B01F 15/00772* (2013.01); *B01F 2215/0036* (2013.01)

(56) References Cited

FOREIGN PATENT DOCUMENTS

| | | | |
|---|---|---|---|
| CN | 205797099 | U | 12/2016 |
| CN | 106823950 | A | 6/2017 |
| CN | 206304597 | U | 7/2017 |
| JP | H07132219 | A | 5/1995 |

* cited by examiner

ELECTRICALLY CONTROLLED MIXING AND BLENDING APPARATUS FOR CHEMICAL LIQUID RAW MATERIALS

FIELD OF THE INVENTION

The present invention relates to the field of electromechanical control, and more particularly to an electrically controlled mixing and blending apparatus for chemical liquid raw materials, and the apparatus has the feature of high corrosion resistance and the capability of mixing and blending chemical liquid raw materials efficiently.

BACKGROUND OF THE INVENTION

Mechanical and chemical industries are inseparable, and these industries spread to all aspects of our life. In modern life, chemical products are used almost anywhere and anytime. From physical life including clothing, food, housing and transportation to spiritual life including culture, art, and entertainment, chemical products are required to serve us. Some chemical products play an important role in the history of human development, and their production and application even represent a certain historical stage of human civilization. Whenever chemical methods are used to change the composition or structure of a substance or synthesize substances to produce a new substance is categorized as chemical production techniques, and the products so produced are called chemicals or chemical products.

Chemical raw materials are often used in mechanical workshops or manufacturing workshops. More specifically, it is necessary to mix a variety of liquid materials during the production of chemical materials, and thus the use of a mixer is required. At present, most mixers commercially available in the market use a motor to drive a stirring rack to rotate in a housing in order to mix various kinds of liquid materials. However, the turbulence of the liquid materials is relatively small, and thus leading to a long time for the conventional mixers to mix various kinds of materials thoroughly and a low production efficiency of the chemical materials.

In view of the aforementioned drawbacks of the prior art, the inventor of the present invention based on years of experience to conduct extensive research and experiment, and finally provided a feasible solution to overcome the drawbacks of the prior art.

SUMMARY OF THE INVENTION

Therefore, it is a primary objective of the present invention to provide an electrically controlled mixing and blending apparatus for chemical liquid raw materials to overcome the aforementioned issues of the conventional mixers that use a motor to drive a stirring rack to rotate in a housing in order to mix various kinds of liquid materials and create a relatively small turbulence of the liquid materials which leads to a long time for the conventional mixers to mix various kinds of materials thoroughly and a low production efficiency of the chemical materials.

To achieve the aforementioned and other objectives, the present invention provides an electrically controlled mixing and blending apparatus for chemical liquid raw materials, and the electrically controlled mixing and blending apparatus comprises a housing, , characterized in that a first bearing is engaged separately to both sides of the housing, and the interior of the two first bearings is engaged to a same first rotating shaft, and a second bearing is engaged to a surface at the middle of the first rotating shaft, and the interior of the second bearing is engaged with a surface of the first motor output shaft, and both sides of the body of the first motor are fixedly coupled to a surface of the first rotating shaft through a first fixed rod, and a blending rod is fixedly coupled to the bottom of the first motor output shaft, and two blending devices are symmetrically mounted onto a surface of the blending rod.

A gear is fixedly coupled to the left end of the first rotating shaft and engaged to a toothed rod, and a sliding rod is fixedly coupled to the bottom of the toothed rod, and a sliding sleeve is fixedly coupled with a surface of the sliding rod, and a surface of the sliding sleeve is operatively coupled to the left side of the housing through the second fixed rod, and the bottom of the sliding rod is fixedly coupled to a side of a driving device through a connecting device, and the bottom of the driving device is fixedly coupled to an upper surface of a bottom plate.

The driving device comprises a second motor, and the bottom of the second motor is fixedly coupled to the upper surface of the bottom plate through a support base, and a turntable is fixedly coupled to an output shaft of the second motor, and a side of the turntable away from the second motor is operatively coupled to an end of the connecting device; the connecting device comprises a second rotating shaft fixedly coupled to a side of the turntable, a third bearing engaged with a surface of the second rotating shaft, a connecting rod fixedly coupled to an upper surface of the third bearing, a third rotating shaft fixedly coupled to a side of the connecting rod top, and a fourth bearing engaged with a surface of the third rotating shaft, and the upper surface of the fourth bearing is fixedly coupled to the bottom of the sliding rod.

The upper surface of the bottom plate is fixedly coupled to the bottom of the housing through the two fixing plates, and a material outlet is formed at the bottom of the housing, and a cover is installed to the bottom of the material outlet.

Preferably, the blending device includes two stirring vanes, and ends of the two stirring vanes are fixedly coupled to a surface of the blending rod, and adjacent ends of the two stirring vanes are fixedly coupled to each other by the vertical rod.

Preferably, the stirring vane includes a V-shaped rod, and both ends of the V-shaped rod are fixedly coupled to a surface of the blending rod, and the interior of the V-shaped rod is fixedly coupled to a stirring rack.

Preferably, the upper surface of the bottom plate is fixedly coupled to a battery, and the upper surface of the battery has a console installed thereon, and the battery is disposed on the right side of the fixing plate.

Preferably, the output terminal of the battery is electrically coupled to the input terminal of the console, and the output terminal of the console is electrically coupled to the input terminal of the first motor and the input terminal of the second motor.

Preferably, the housing is U-shaped, and the housing has a material inlet formed at the top thereof.

Preferably, the blending rod swings with a total swing angle of 90 degrees along the front-rear direction.

The electrically controlled mixing and blending apparatus for chemical liquid raw materials in accordance with the present invention has the following advantages: (1) The electrically controlled mixing and blending apparatus for chemical liquid raw materials comes with the U-shaped housing, first motor, blending rod, blending device, driving device, connecting device, sliding rod, sliding sleeve, toothed rod, gear, first bearing and first rotating shaft, wherein the first motor drives the blending rod and the blending device to rotate in the housing and the second motor drives the turntable to rotate and drive the sliding rod and the toothed rod to ascend and descend reciprocately through the connecting device, so that the gear can drive the first motor, blending rod and stirring rack to swing in a front-rear direction through the first rotating shaft to achieve the effects of increasing the turbulence of the chemical liquid raw materials in the housing, shortening the time required for mixing the chemical liquid raw materials, and improving the production efficiency of the chemical materials. (2) The electrically controlled mixing and blending apparatus for chemical liquid raw materials comes with the V-shaped rod and stirring rack, so that the chemical liquid raw materials in the housing can be mixed more uniformly and quickly to improve the production efficiency of the chemical products. (3) The electrically controlled mixing and blending apparatus for chemical liquid raw materials has the features of compact structure, reasonable design, and high practicality.

BRIEF DESCRIPTION OF NUMERALS IN THE FIGS

1: Housing; 2: First bearing; 3: First rotating shaft; 4: Second bearing; 5: Driving device; 51: Second motor; 52: Support base; 53: Turntable; 6: Connecting device; 61: Second rotating shaft; 62: Third bearing; 63: Connecting rod; 64: Third rotating shaft; 65: Fourth bearing; 7: Blending device; 71: Vertical rod; 72: Stirring vane; 721: V-shaped rod; 722: Stirring rack; 8: First motor; 9: First fixed rod; 10: Blending rod; 11: Gear; 12: Toothed rod; 13: Sliding rod; 14: Sliding sleeve; 15: Second fixed rod; 16: Bottom plate; 17: Fixing plate; 18: Material outlet; 19: Cover; 20: Battery; 21: Console.

DESCRIPTION OF THE PREFERRED EMBODIMENTS

The technical contents of the present invention will become apparent with the detailed description of preferred embodiments accompanied with the illustration of related drawings as follows. It is intended that the embodiments and figures disclosed herein are to be considered illustrative rather than restrictive.

Figure 1:
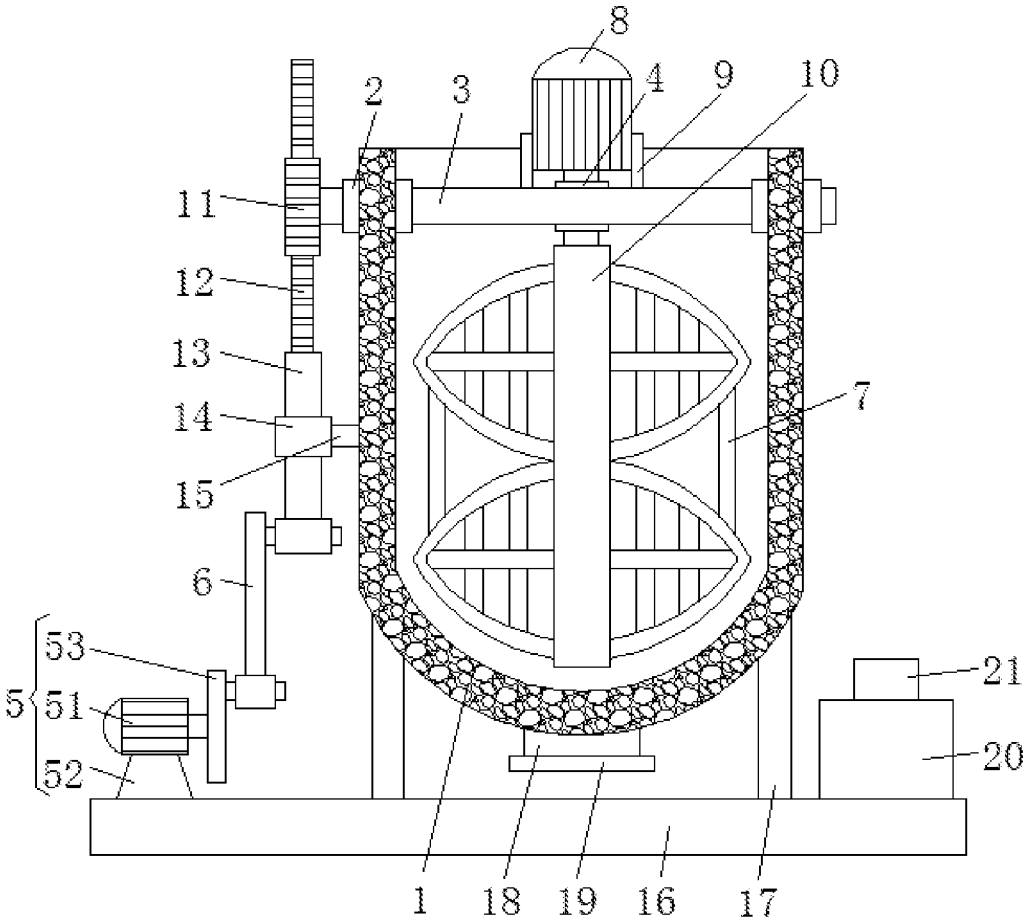
FIG. 1 is a cross-sectional front view of the present invention.
Figure 2:
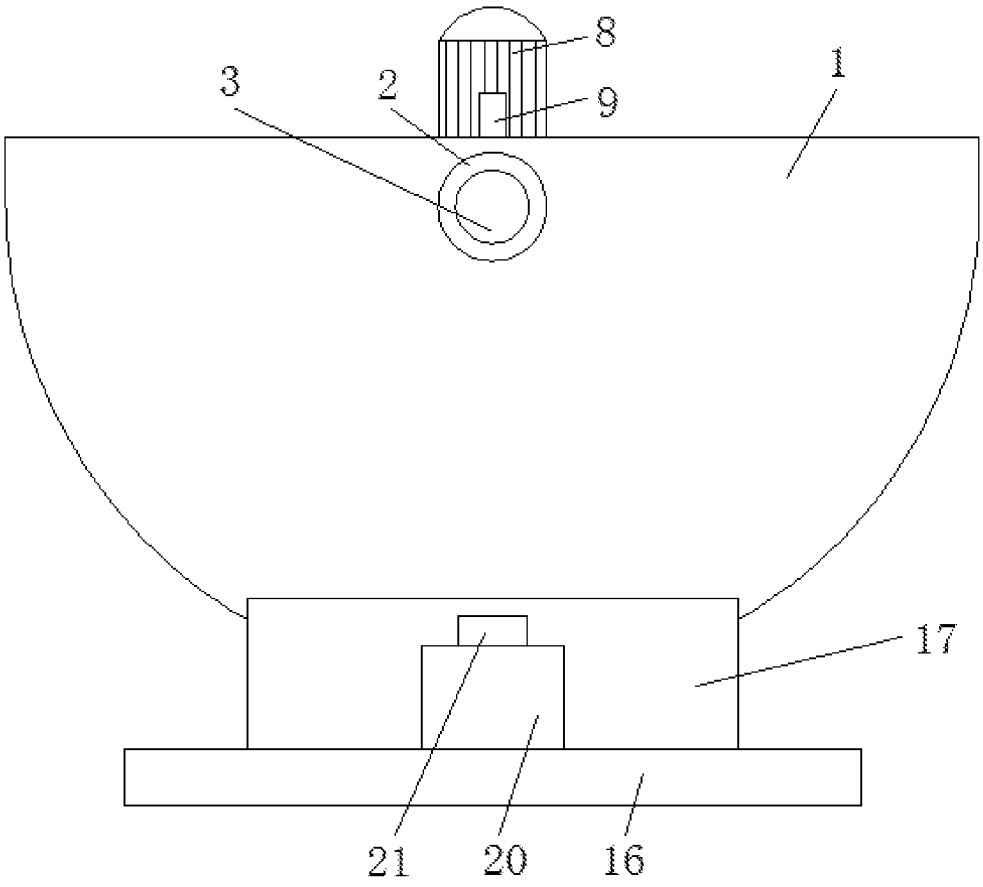
FIG. 2 is a right view of the present invention.
Figure 3:
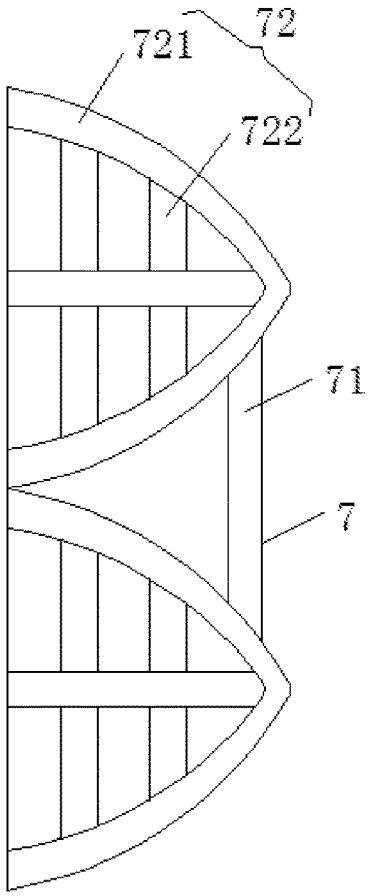
FIG. 3 is a front view of a blending device of the present invention.
Figure 4:
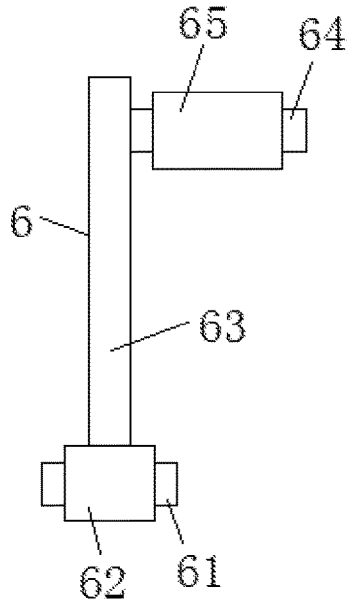
FIG. 4 is a front view of a connecting device of the present invention.
Figure 5:
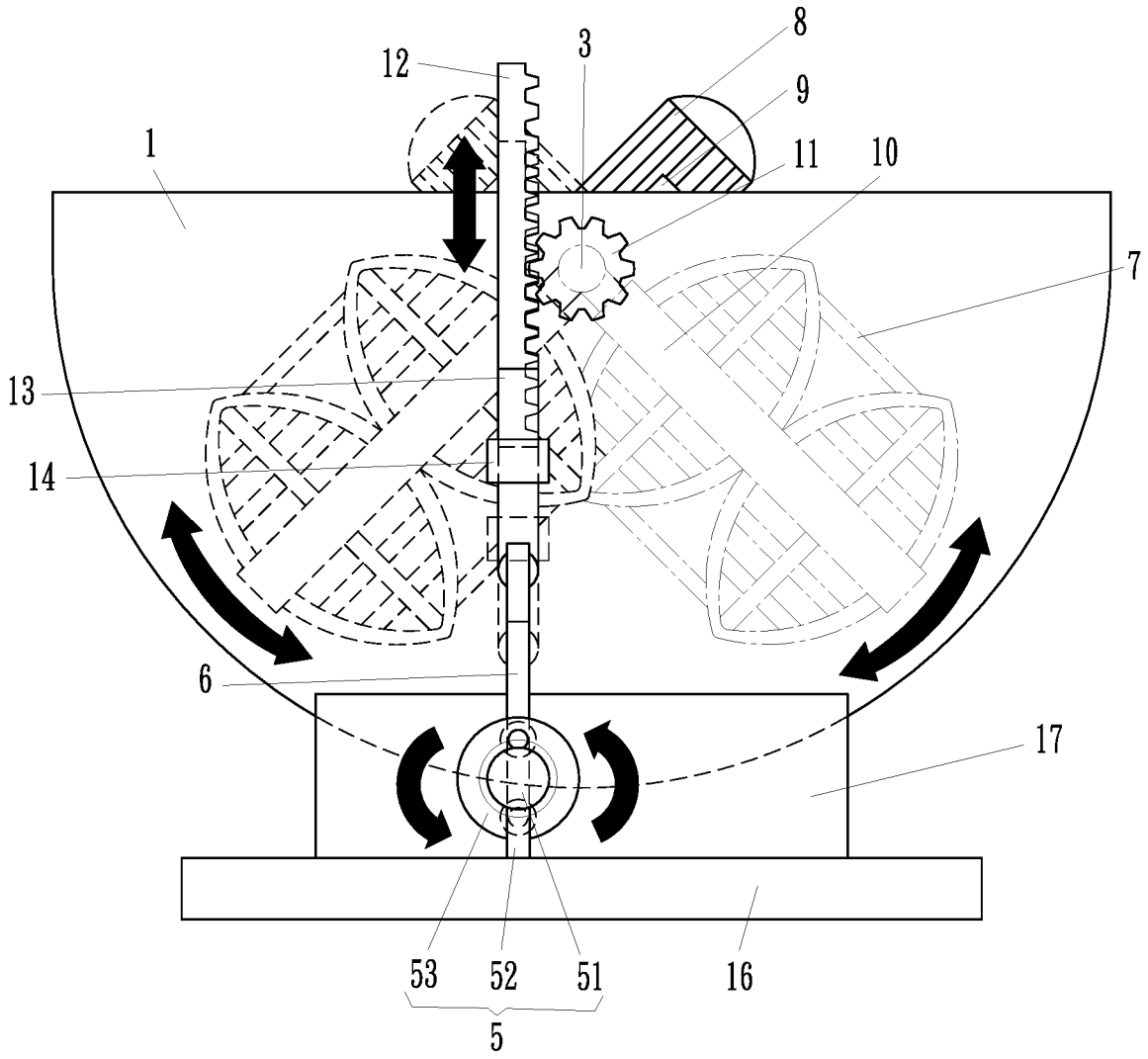
FIG. 5 is a right view showing a total swing angle of a blending rod of the present invention.

With reference to FIGS. 1 to 4 for an electrically controlled mixing and blending apparatus for chemical liquid raw materials in accordance with the present invention, the apparatus comprises: a U-shaped housing 1 for assuring that a blending rod 10 and a blending device 7 can swing in a front-rear direction in order to mix the chemical liquid raw materials; a material inlet formed at the top of the housing 1 and provided for pouring the chemical liquid raw materials into the housing 1; a first bearing 2 engaged to both sides of the housing 1 separately, and the interior of the two first bearings 2 being engaged with a same first rotating shaft 3, so that a first motor 8, the blending rod 10 and the blending device 7 can swing in the front-rear direction through the first bearing 2 and the first rotating shaft 3 in order to mix the chemical liquid raw materials; a second bearing 4 engaged with a surface of the first rotating shaft 3, and the interior of the second bearing 4 being engaged with a surface of an output shaft of the first motor 8, and both sides of the first motor 8 being fixedly coupled to a surface of the first rotating shaft 3 through a first fixed rod 9, and the bottom of the output shaft of the first motor 8 being fixedly coupled to the blending rod 10, and two blending devices 7 being symmetrically mounted onto a surface of the blending rod 10, so that the first motor 8 can drive the blending rod 10 and the blending device 7 to rotate by the configuration of the first motor 8, blending rod 10 and blending device 7, so as to achieve the effects of stirring the chemical liquid raw materials in the housing 1 and mixing the chemical liquid raw materials. In addition, the blending device 7 comprises two stirring vanes 72, and ends of the two stirring vanes 72 are fixedly coupled to a surface of the blending rod 10 and the blending rod 10 swings at a total swing angle of 90 degrees in the front-rear direction. In other words, the blending rod 10 can swing frontwardly to an angle of 45 degrees or backwardly to an angle of 45 degrees to mix the chemical liquid raw materials quickly, and adjacent ends of the two stirring vanes 72 are fixedly coupled by the vertical rod 71. The stirring vane 72 comprises a V-shaped rod 721, and both ends of the V-shaped rod 721 are fixedly coupled to a surface of the blending rod 10, and the interior of the V-shaped rod 721 is fixedly coupled to a stirring rack 722. With the V-shaped rod 721 and the stirring rack 722, the chemical liquid raw materials in the housing 1 can be mixed more uniformly and quickly to improve the production efficiency of the chemical products.

A gear 11 is fixedly coupled to the left end of the first rotating shaft 3 and engaged with a toothed rod 12. With the configuration of the toothed rod 12 and gear 11, the toothed rod 12 can be moved up and down reciprocately to drive the gear 11 to rotate in both forward and reverse directions alternately, so that the first rotating shaft 3 can drive the blending rod 10 and the blending device 7 to swing in the front-rear direction reciprocately to mix the chemical liquid raw materials in the housing 1 uniformly, and a sliding rod 13 is fixedly coupled to the bottom of the toothed rod 12, and a sliding sleeve 14 is fixedly coupled with a surface of the sliding rod 13, and a surface of the sliding sleeve 14 is operatively coupled to the left side of the housing 1 through the second fixed rod 15, and the bottom of the sliding rod 13 is fixedly coupled to a side of the driving device 5 through a connecting device 6. With the configuration of the sliding rod 13 and the sliding sleeve 14, the toothed rod 12 can be ascended or descended more conveniently. The bottom of the driving device 5 is fixedly coupled to the upper surface of the bottom plate 16.

The driving device 5 includes a second motor 51, and the bottom of the second motor 51 is fixedly coupled to the upper surface of the bottom plate 16 through a support base 52, and a turntable 53 is fixedly coupled to an output shaft of the second motor 51. With the configuration of the second motor 51 and the turntable 53, the output shaft of the second motor 51 drives the turntable 53 to rotate, and the turntable 53 drives the second rotating shaft 61 to move up and down, so as to achieve the effect of ascending and descending the sliding rod 13 reciprocately. The second rotating shaft 61 is biasedly disposed on a side of the turntable 53, and a side of the turntable 53 away from the second motor 51 is operatively coupled to an end of the connecting device 6, and a battery 20 is fixedly coupled to the upper surface of the bottom plate 16, and a console 21 is mounted onto the upper surface of the battery 20, and the battery 20 is disposed on the right side of the fixing plate 17, and an output terminal of the battery 20 is electrically coupled to an input terminal of the console 21, and an output terminal of the console 21 is electrically coupled to the input terminal of the first motor 8 and the input terminal of the second motor 51. With the configuration of the battery 20 and the console 21, the first motor 8 and the second motor 51 can be operated and controlled more conveniently. The output shaft of the second motor 51 drives the turntable 53 to rotate, and the turntable 53 drives the sliding rod 13 and the sliding sleeve 14 to move up and down reciprocity through the connecting device 6; a sliding rod 13 is fixedly coupled to the bottom of the toothed rod 12 mesh with the gear 11 which is fixedly coupled to the left end of the first rotating shaft 3, the toothed rod 12 drives the gear 11 to rotate in the forward and reverse directions repeatedly; and the gear 11 drives the first rotating shaft 3 to drive the blending rod 10 and the blending device 7 to swing in the front-rear direction repeatedly.

The connecting device 6 includes a second rotating shaft 61 fixedly coupled to a side of the turntable 53, and a third bearing 62 engaged with a surface of the second rotating shaft 61. With the second rotating shaft 61 and the third bearing 62, the connecting rod 63 can rotate around the second rotating shaft 61. A connecting rod 63 is fixedly coupled to the upper surface of the third bearing 62, and a third rotating shaft 64 is fixedly coupled to the top of the connecting rod 63, and a fourth bearing 65 is engaged with a surface of the third rotating shaft 64. With the third rotating shaft 64 and the fourth bearing 65, the connecting rod 63 can rotate around the third rotating shaft 64 to assure the effect of ascending and descending the sliding rod 13. The upper surface of the fourth bearing 65 is fixedly coupled to the bottom of the sliding rod 13.

The upper surface of the bottom plate 16 is fixedly coupled to the bottom of the housing 1 through the two fixing plates 17, so that the housing 1 can be fixed more securely, and a material outlet 18 is formed at the bottom of the housing 1, and a cover 19 is installed to the bottom of material outlet 18. With the material outlet 18 and the cover 19, the chemical materials can be taken out conveniently.

During use, a variety of chemical liquid raw materials are poured into the housing 1 through the material inlet formed at of the top of the housing 1, wherein the total volume of the chemical liquid raw materials is approximately equal to two-third of the total volume of the housing 1, and the first motor 8 and the second motor 51 are operated through the console 21. The first motor 8 drives the blending rod 10 and the blending device 7 to rotate, so as to stir the chemical solutions in the housing 1. The output shaft of the second motor 51 drives the turntable 53 to rotate, and the turntable 53 drives the sliding rod 13 and the toothed rod 12 to move up and down reciprocately through the connecting device 6, and the toothed rod 12 drives the gear 11 to rotate in the forward and reverse directions reciprocately, and the gear 11 drives the first rotating shaft 3 to rotate in the forward and reverse directions reciprocately. The first rotating shaft 3 drives the first motor 8, the blending rod 10 and the blending device 7 to swing in the front-rear direction reciprocately to mix the chemical liquid raw materials in the housing 1 uniformly and quickly. After the chemical liquid raw materials in the housing 1 are mixed uniformly, the first motor 8 and the second motor 51 are turned off through the console 21. Finally, the mixed chemical liquid materials are taken out through the material outlet 18.

In summation of the description above, the electrically controlled mixing and blending apparatus for chemical liquid raw materials comes with the U-shaped housing 1, first motor 8, blending rod 10, blending device 7, driving device 5, connecting device 6, sliding rod 13, sliding sleeve 14, toothed rod 12, gear 11, first bearing 2 and first rotating shaft 3, wherein the first motor 8 drives the blending rod 10 and the blending device 7 to rotate in the housing 1. In the meantime, the second motor 51 drives the turntable 53 to rotate, and the turntable 53 drives the sliding rod 13 and the toothed rod 12 to ascend and descend reciprocately through the connecting device 6, so that the gear 11 can drive the first motor 8, the blending rod 10 and the stirring rack 722 to swing reciprocately through the first rotating shaft 3 to achieve the effects of increasing the turbulence of the chemical liquid raw materials in the housing 1, reducing the time required for mixing the chemical liquid raw materials uniformly, and improving the production efficiency of the chemical products. The electrically controlled mixing and blending apparatus for chemical liquid raw materials comes with the V-shaped rod 721 and the stirring rack 722, so that the chemical liquid raw materials in the housing 1 can be mixed more uniformly and quickly to improve the production efficiency of the chemical products. The electrically controlled mixing and blending apparatus for chemical liquid raw materials has the features of compact structure, reasonable design, and high practicality.

While the present invention has been described by means of specific embodiments, numerous modifications and variations could be made thereto by those skilled in the art without departing from the scope and spirit of the present invention set forth in the claims.

What is claimed is:

1. An electrically controlled mixing and blending apparatus for chemical liquid raw materials, comprising a housing, characterized in that a first bearing is engaged separately to both sides of the housing, and the interior of the two first bearings is engaged to a same first rotating shaft, and a second bearing is engaged to a surface at the middle of the first rotating shaft, and the interior of the second bearing is engaged with a surface of an output shaft of a first motor, and both sides of the body of the first motor are fixedly coupled to a surface of the first rotating shaft through a first fixed rod, and a blending rod is fixedly coupled to the bottom of the first motor output shaft, and two blending devices are symmetrically mounted onto a surface of the blending rod;

a gear is fixedly coupled to the left end of the first rotating shaft and engaged to a toothed rod, and a sliding rod is fixedly coupled to the bottom of the toothed rod, and a sliding sleeve is fixedly coupled with a surface of the sliding rod, and a surface of the sliding sleeve is operatively coupled to the left side of the housing through a second fixed rod, and the bottom of the sliding rod is fixedly coupled to a side of a driving device through a connecting device, and the bottom of the driving device is fixedly coupled to an upper surface of a bottom plate;

the driving device comprises a second motor, and the bottom of the second motor is fixedly coupled to the upper surface of the bottom plate through a support base, and a turntable is fixedly coupled to an output shaft of the second motor, and a side of the turntable away from the second motor is operatively coupled to an end of the connecting device;

the connecting device comprises a second rotating shaft fixedly coupled to a side of the turntable, a third bearing engaged with a surface of the second rotating shaft, a connecting rod fixedly coupled to an upper surface of the third bearing, a third rotating shaft fixedly coupled to a side of the connecting rod top, and a fourth bearing engaged with a surface of the third rotating shaft, and the upper surface of the fourth bearing is fixedly coupled to the bottom of the sliding rod; and the upper surface of the bottom plate is fixedly coupled to the bottom of the housing through two fixing plates, and a material outlet is formed at the bottom of the housing, and a cover is installed to the bottom of the material outlet.

2. The electrically controlled mixing and blending apparatus for chemical liquid raw materials according to claim 1, wherein the blending device includes two stirring vanes, and ends of the two stirring vanes are fixedly coupled to a surface of the blending rod, and adjacent ends of the two stirring vanes are fixedly coupled to each other by a vertical rod.

3. The electrically controlled mixing and blending apparatus for chemical liquid raw materials according to claim 2, wherein the stirring vane includes a V-shaped rod, and both ends of the V-shaped rod are fixedly coupled to a surface of the blending rod, and the interior of the V-shaped rod is fixedly coupled to a stirring rack.

4. The electrically controlled mixing and blending apparatus for chemical liquid raw materials according to claim 1, wherein the upper surface of the bottom plate is fixedly coupled to a battery, and the upper surface of the battery has a console installed thereon, and the battery is disposed on the right side of the fixing plate.

5. The electrically controlled mixing and blending apparatus for chemical liquid raw materials according to claim 4, wherein an output terminal of the battery is electrically coupled to an input terminal of the console, and an output terminal of the console is electrically coupled to an input terminal of the first motor and an input terminal of the second motor.

6. The electrically controlled mixing and blending apparatus for chemical liquid raw materials according to claim 1, wherein the housing is U-shaped, and the housing has a material inlet formed at the top thereof.

7. The electrically controlled mixing and blending apparatus for chemical liquid raw materials according to claim 1, wherein the blending rod swings with a total swing angle of 90 degrees along the front-rear direction.

* * * * *